US007159520B2

(12) United States Patent
Casey et al.

(10) Patent No.: US 7,159,520 B2
(45) Date of Patent: Jan. 9, 2007

(54) AMUSEMENT RIDE VEHICLE INCLUDING AN ARTICULATION JOINT

(75) Inventors: Joseph Casey, Orlando, FL (US); Cindy Emerick, Camden, OH (US); Ben Lovelace, Orlando, FL (US); Frank Weigand, La Canada, CA (US); Bill Whitcomb, Saugus, CA (US); Jim Seay, Baltimore, MD (US); Glen Hartung, Mission Viejo, CA (US)

(73) Assignee: Universal City Studios LLP, Universal City, CA (US)

( * ) Notice: Subject to any disclaimer, the term of this patent is extended or adjusted under 35 U.S.C. 154(b) by 0 days.

(21) Appl. No.: 10/953,173

(22) Filed: Sep. 28, 2004

(65) Prior Publication Data

US 2006/0065151 A1 Mar. 30, 2006

(51) Int. Cl.
*A63G 1/00* (2006.01)

(52) U.S. Cl. ..... 104/63

(58) Field of Classification Search ..... 104/53, 104/56, 63, 64; 213/75 R; 105/3
See application file for complete search history.

(56) References Cited

U.S. PATENT DOCUMENTS 1,480,678 A * 1/1924 Feucht ..... 213/46 R
2,321,613 A 6/1943 Ostermann
2,857,056 A 10/1958 Dilworth
4,170,943 A * 10/1979 Achrekar ..... 104/56
4,682,547 A * 7/1987 Schwarzkopf ..... 104/53
6,269,749 B1 * 8/2001 Hogg ..... 104/53

FOREIGN PATENT DOCUMENTS

DE 2263317 A1 6/1974
FR 2447840 A 8/1980

* cited by examiner

*Primary Examiner*—S. Joseph Morano
*Assistant Examiner*—Robert J. McCarry, Jr.
(74) *Attorney, Agent, or Firm*—Mark A. Conklin; Roger C. Phillips

(57) ABSTRACT

An amusement ride vehicle includes a first vehicle section, a second vehicle section, and an articulation joint connecting, and providing rotational movement between, the first and second vehicle sections. The articulation joint comprises a first shaft for bearing loads during normal operation of the joint, and a second shaft within the first shaft for bearing loads when the first shaft is inoperable. A test element, such as a lever, is attached to the second shaft. The second shaft is rotatable via the test element during normal operation of the joint. When the first shaft is inoperable, the second shaft handles loads acting on the articulation joint, and is not rotatable via the test element, thus indicating a failure of the first shaft.

20 Claims, 3 Drawing Sheets

10
12
14
16
18
20
22
26
30
40
42

AMUSEMENT RIDE VEHICLE INCLUDING AN ARTICULATION JOINT

BACKGROUND OF THE INVENTION

Amusement rides, such as roller coasters, typically include vehicles that ride on tracks or rails. The vehicles or cars may include multiple vehicle sections connected by couplings. Several vehicle sections are often connected to one another to increase the rider capacity of the amusement ride. Depending on the track configuration and the relative size of the vehicle sections, two or more vehicle sections may be required to turn and/or rotate relative to one another to accommodate curves in the track.

Amusement rides often include very tight curves, particularly if a ride is set up in a relatively small area, e.g., in an indoor facility, or in a compact outdoor area. Tight or small radius curves may also be used to enhance the overall ride sensation, by creating larger "g" forces on the riders, even at lower speeds. One resulting disadvantage of tight curves is that the ride vehicle typically has to be shortened in overall length, so that it can safely and effectively navigate through the tight curves. As a result, the rider capacity, or number of seats, is typically reduced. This often leads to longer lines and wait times for the amusement ride.

Another common problem associated with amusement rides or coasters is downtime resulting from a malfunctioning ride vehicle. This can result when a joint or coupling between vehicle sections malfunctions. If a joint or coupling malfunctions during use, the entire amusement ride generally has to be temporarily stopped, at least until the joint can be fixed or the vehicle can be removed from the track.

Even with thorough daily inspections and maintenance, vehicle couplings can still malfunction during ride operation. For this reason, current ride systems that have an articulation joint as part of their assembly may be equipped with a backup system. These backup systems, however, are typically not designed to bear the same loads, or to permit the same articulation between vehicle sections, as the primary articulation system. As a result, the ride vehicle will generally have to be taken offline for repairs when a joint malfunction occurs. Accordingly, a need exists for an improved amusement ride vehicle that can accommodate tight curves, while seating several passengers, and allowing the amusement ride to continue to operate when a joint or coupling between vehicle sections malfunctions.

SUMMARY OF THE INVENTION

The invention is directed to an amusement ride vehicle including a first vehicle section, a second vehicle section, and an articulation or pivot joint connecting, and providing rotational or pivotal movement between, the first and second vehicle sections.

In one aspect, the articulation joint comprises a first shaft for bearing loads during normal operation of the joint, and a second shaft within the first shaft for bearing loads when the first shaft is inoperable.

In another aspect, a test element, such as a handle or lever, is attached to the second shaft. The second shaft is rotatable via the test element during normal operation of the joint, i.e., when the first shaft is bearing the loads acting on the joint. When the first shaft fails, or is otherwise inoperable, the second shaft handles the loads acting on the joint, and is therefore not rotatable via the test element, thus indicating that the first shaft is out of order.

Other features and advantages of the invention will appear hereinafter. The features of the invention described above can be used separately or together, or in various combinations of one or more of them. The invention resides as well in sub-combinations of the features described.

BRIEF DESCRIPTION OF THE DRAWINGS

In the drawings, wherein similar reference characters denote similar elements throughout the several views.

DETAILED DESCRIPTION OF THE DRAWINGS

Figures 1, 2:
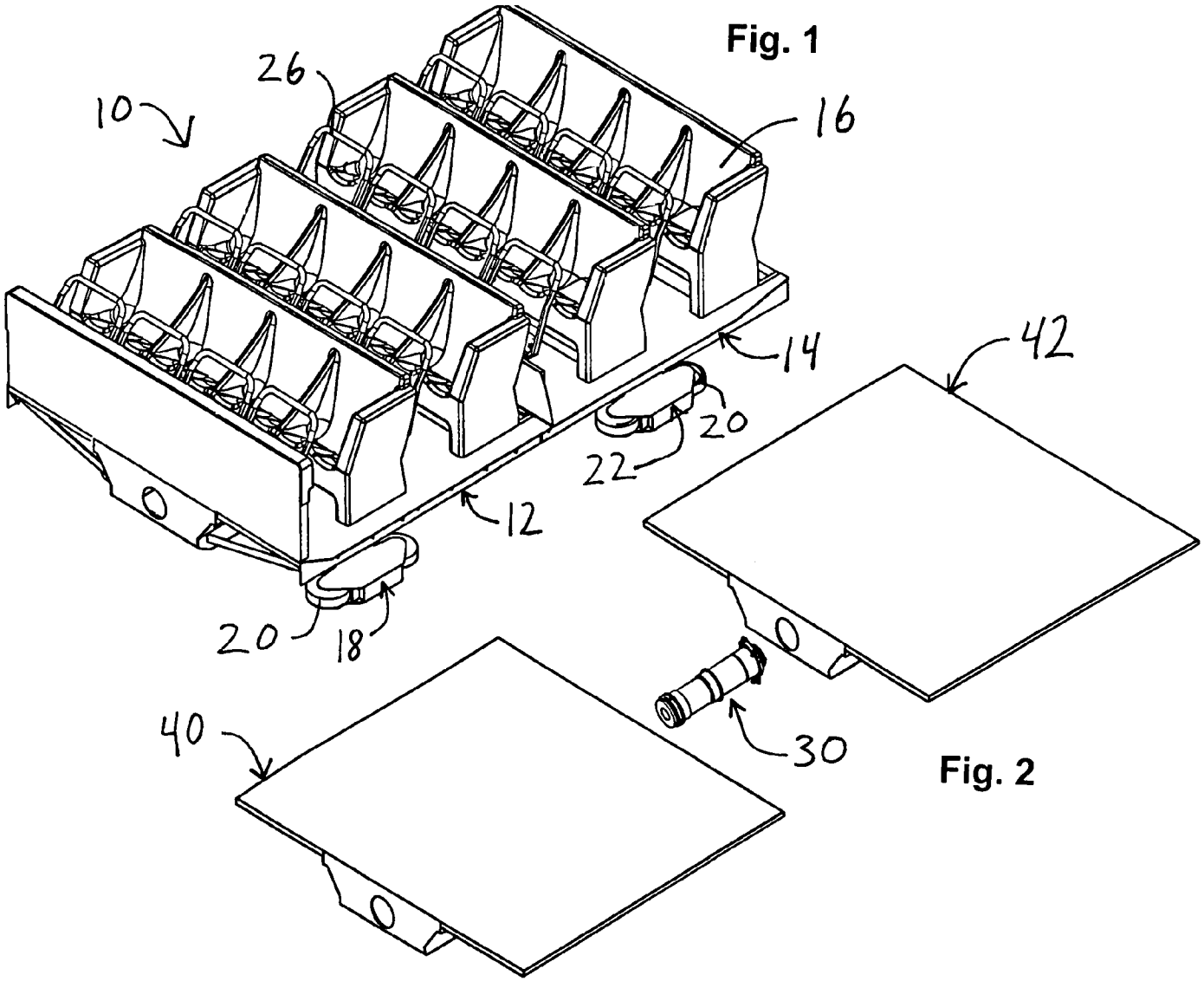
FIG. 1 is a perspective view of an amusement ride vehicle.
FIG. 2 is a partial exploded view of the chassis and articulation joint of the amusement ride vehicle shown in FIG. 1.

Turning now in detail to the drawings, FIG. 1 illustrates an amusement ride or roller coaster vehicle 10 having a first or front vehicle section 12 attached to a second or rear vehicle section 14. Each of the first and second vehicle sections 12, 14 includes two rows of four seats 16, such that the amusement ride vehicle 10 includes a total of sixteen seats 16. Any other suitable number of vehicle sections, having any suitable number of seat rows, may alternatively be used.

A passenger restraint device, such as a lap bar 26, a shoulder bar, and/or a seat belt, etc., is preferably provided at each seat 16 for holding a passenger in the seat 16 during movement of the vehicle 10. The types of restraints used typically depend on the types of movements that the amusement ride vehicle 10 performs. For example, if the amusement ride vehicle 10 performs upside down movements, shoulder restraints may be used.

A pair of front wheel assemblies 18 is attached to opposite sides of the first vehicle section 12, adjacent to the bottom of the first vehicle section 12. A pair of rear wheel assemblies 22 is similarly attached to the bottom of the second vehicle section 14. Wheels 20 on the front and rear wheel assemblies 18, 22 are configured to engage the track or rails of an amusement ride. The front and rear wheel assemblies 18, 22 roll along, and secure the ride vehicle 10 to, the track or rails. A greater or lesser number of wheel assemblies may be used to meet the requirements of any given amusement ride.

The front and rear wheel assemblies 18, 22 preferably each include two or more vertically-oriented wheels (not visible in the drawings) attached to an arm or shaft that is pivotable about a horizontal axis and a vertical axis. The vertically-oriented wheels preferably ride on top of the track or rails. When the amusement ride 10 enters a vertical pitch in the track, the arm or shaft pivots about the horizontal axis so that the wheels navigate the track and the ride vehicle 10 does not undergo significant vertical bending stresses. When the amusement ride 10 enters a horizontal turn in the track, the arm or shaft pivots about the vertical axis so that the wheels navigate the track and the ride vehicle 10 does not undergo significant horizontal bending stresses. Any other suitable wheel assembly configuration may alternatively be used to accommodate pitch and yaw movements of the ride vehicle 10, as is well known in the art.

FIG. 2 is a partially exploded view of a first chassis section 40 of the first vehicle section 12, and a second chassis section 42 of the second vehicle section 14. The first and second chassis sections 40, 42 are preferably constructed from steel or any other suitable material, and are connected by a joint 30. The joint 30 provides relative rotation about a longitudinal axis of the joint 30 between the first and second vehicle sections 12, 14, and is thus referred to as an articulation joint 30. The articulation joint 30 allows the amusement ride vehicle 10 to travel through tight curves in the ride track. The degree of relative rotation between the first and second vehicle sections 12, 14, provided by the articulation joint 30, is preferably limited only by the configuration of the ride track.

Figure 3:
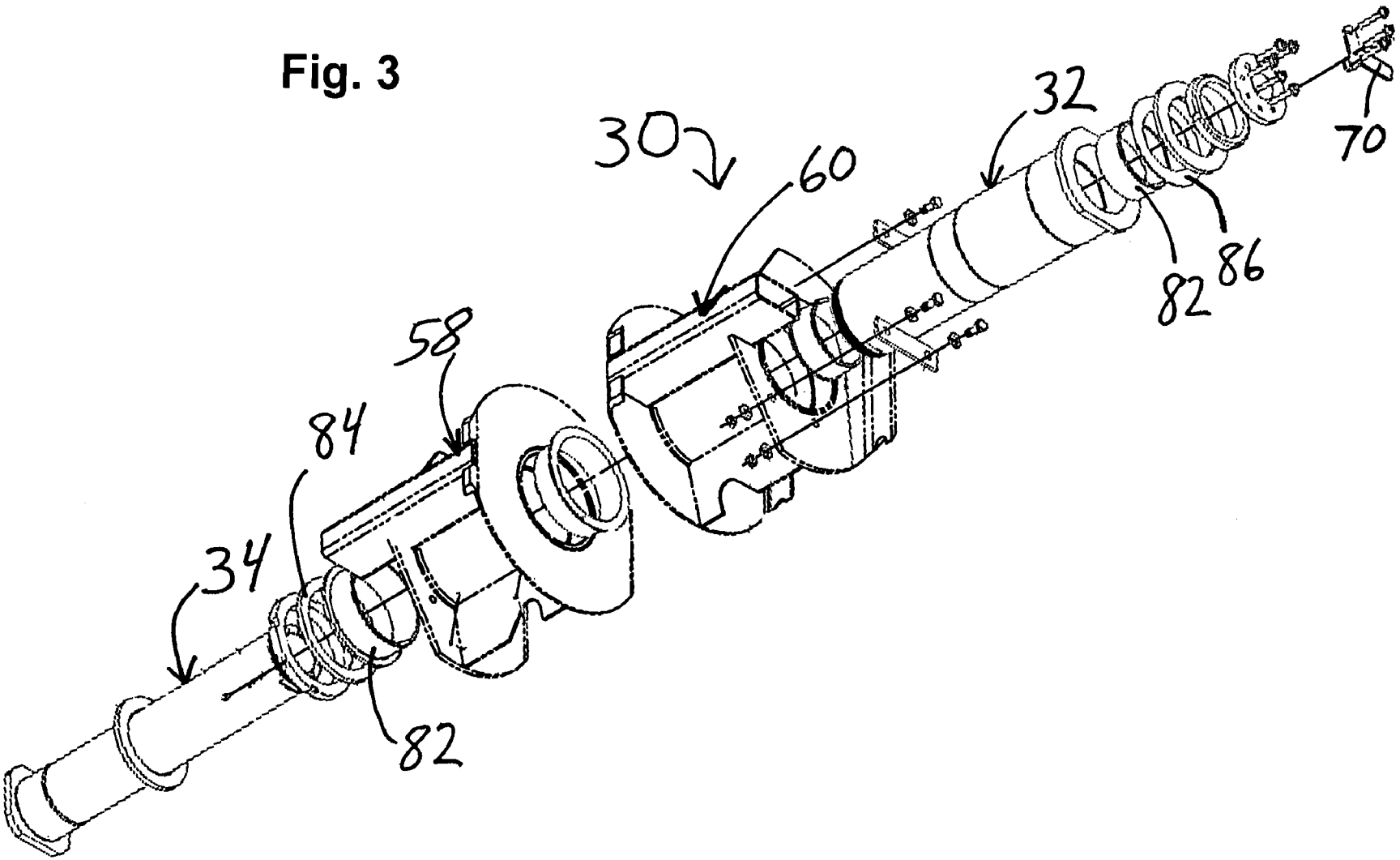
FIG. 3 is an exploded view of the articulation joint shown in FIG. 2.
Figure 5:
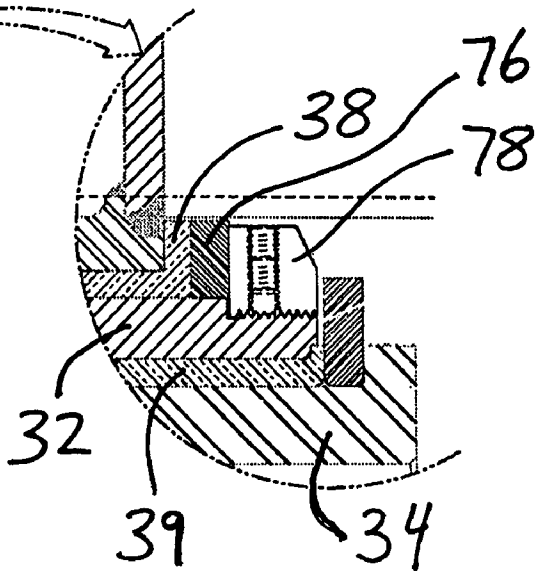
FIG. 5 is a magnified sectional view of Section A from FIG. 4.
Figure 4:
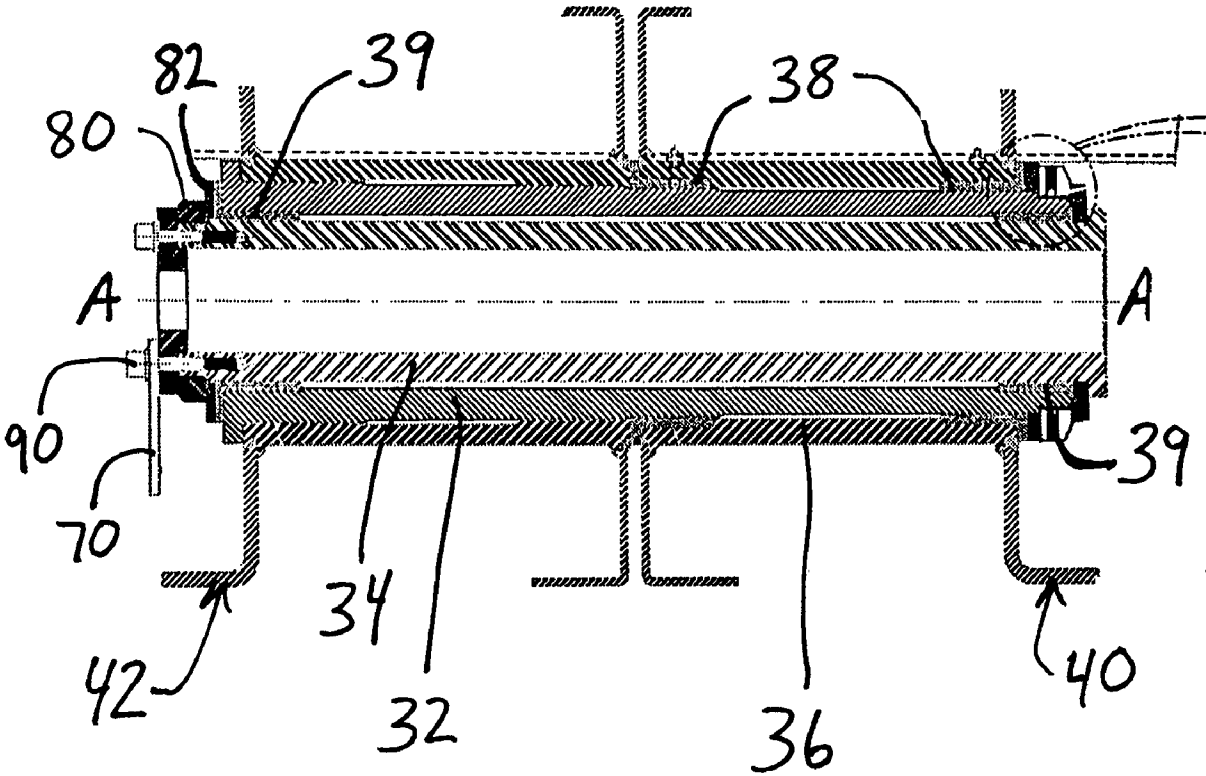
FIG. 4 is a side-sectional view of the articulation joint illustrated in FIG. 3 connected to front and rear vehicle chassis sections.

FIGS. 3–5 illustrate details of the articulation joint 30 according to a preferred embodiment. The articulation joint 30 preferably includes a hollow cylindrical primary shaft 32 connected to the first and second vehicle sections 12, 14, and a hollow cylindrical secondary shaft 34 positioned concentrically within the primary shaft 32 and connected to the first and second vehicle sections 12, 14. The primary shaft 32 is preferably positioned concentrically within a chassis tube 36. The chassis tube 36 connects into the first and second chassis sections 40, 42, and is rotatable or pivotable about the primary shaft 32 to provide relative rotation about a longitudinal axis (front-to-back axis A—A) between the first and second vehicle sections 12, 14.

The primary shaft 32 preferably has a length of approximately 18 to 24 inches, or approximately 21 inches, an outer diameter of approximately 5.5 to 6.0 inches, or approximately 5.75 inches, and an inner diameter of approximately 4.1 to 4.7 inches, or approximately 4.4 inches. The secondary shaft 34 preferably has a length of approximately 20 to 26 inches, or approximately 23 inches, an outer diameter of approximately 3.75 to 4.25 inches, or approximately 4.0 inches, and an inner diameter of approximately 2.25 to 2.75 inches, or approximately 2.5 inches. Of course, the primary and secondary shafts 32, 34 may be larger or smaller depending on the size and weight of the first and second vehicle sections 12,14.

A first or outer set of bearings 38 is preferably pressed into the chassis tube 36 such that the bearings 38 are positioned between the chassis tube 36 and the primary shaft 32. Alternatively, roller bearings, ball bearings, or other suitable bearings could be are positioned between the chassis tube 36 and the primary shaft 32. A second or inner set of bearings 39 is preferably positioned between the primary shaft 32 and the secondary shaft 34. The first and second sets of bearings 38, 39 are preferably made of brass or another suitable material. The chassis tube 36 is rotatable against the first set of bearings 38, about the primary shaft 32, during normal operation of the amusement ride vehicle 10. The primary shaft 32 is rotatable against the second set of bearings 39, about the secondary shaft 34, when the primary shaft 32 fails or is otherwise inoperable, as further described below.

As illustrated in FIG. 3, the articulation joint 30 preferably includes a first chassis assembly 58 for attachment to a rear face of the first chassis section 40 or to a front face of the second chassis section 42, and a second chassis assembly 60 for attachment to the other of the front face of the second chassis section 42 and the rear face of the first chassis section 40. The primary and secondary shafts 32, 34 enter and engage the first and second chassis sections 40, 42 through central openings in the first and second chassis assemblies 58, 60. The articulation joint 30 preferably further includes bushings 82, spacers 84, washers 86, etc., to facilitate articulating movement and/or secure connection between the various joint components.

As illustrated in FIG. 5, the primary shaft 32 is preferably threaded into a primary lock ring, or primary lock nut 78, that is separated from one of the bearings 38 by a spacer 76. The primary lock nut 78 applies a force in the axial, or longitudinal (along axis A—A) direction, and handles and distributes thrust loads acting on the articulation joint 30 during normal operation of the articulation joint 30. As illustrated in FIG. 4, the secondary shaft 34 is preferably threaded into a secondary lock ring, or secondary lock nut 80, that is separated from one of the bearings 39 by a spacer 82. The secondary lock nut 80 handles and distributes thrust loads acting on the articulation joint 30 when the primary shaft 32 is broken, or otherwise inoperable, as described below.

A test element, such as a handle, lever, nut, access hole, or other suitable means, is attached to or otherwise in communication with the secondary shaft 34 for providing rotation to the secondary shaft 34. A test handle 70, which is attached to the secondary shaft 34 via one or more bolts 90 or other suitable attachment means, will be described herein by way of example only. During normal operation of the articulation joint 30, the test handle 70 may be pushed or pulled by an inspector to rotate the secondary shaft 34, indicating that the primary shaft 32 is operating properly, as described below. When the ride vehicle 10 is at rest on a track, the test handle 70 preferably projects downwardly (due to gravity) and extends nearly to the bottom of the amusement ride vehicle 10, so that an inspector standing beneath the track may reach up and push or pull the handle 70.

In use, one or more amusement ride vehicles 10 are positioned on the track or rails of an amusement ride. Riders board an amusement ride vehicle 10 and sit in the vehicle seats 16. The lap bars 26 and/or other restraints are then lowered or engaged and locked into place, to secure the riders in the vehicle 10. Once the riders are safely restrained in their seats 16, the amusement ride vehicle 10 begins to move along the track or rails, via a pulling mechanism located under the track, a launch mechanism, or other propulsion systems.

When the ride vehicle 10 comes to a combined horizontal and vertical curve in the track, the first vehicle section 12 enters the curve and rotates about axis A—A relative to the second vehicle section 14, via the articulation joint 30. Specifically, the chassis tube 36 rotates against the bearings 38 about the primary shaft 32, allowing the first vehicle section 12 to rotate relative to the second vehicle section 14 as it enters the curve. The second vehicle section 14 then enters the curve and rotates relative to the first vehicle 12 in a similar manner. As the amusement ride vehicle 10 continues along the track, it moves through the various turns and curves in the track in the same manner.

Under normal ride vehicle operating conditions, the primary shaft 32 handles the radial and axial loads acting on the articulation joint 30. The primary shaft 32, accordingly, remains relatively stationary (although it may rotate somewhat) while the chassis tube 36 rotates about the primary shaft 32. The secondary shaft 34, conversely, does not handle any of the loads under normal operating conditions, and is therefore free to rotate within the primary shaft 32.

If the primary shaft 32 fails, breaks, or otherwise becomes inoperable, the secondary shaft 34 takes on the role of the primary shaft 32, due to the arrangement of the primary and secondary shafts 32, 34, and handles the loads acting on the articulation joint 30, i.e., the secondary shaft 34 assumes the load-bearing role of the primary shaft 32. The secondary shaft 34 is preferably at least as strong as the primary shaft 32 for handling the loads. As a result, the amusement ride vehicle 10 can continue to operate if the primary shaft 32 fails during ride operation.

Between daily operations, an inspector preferably inspects the amusement ride vehicle 10 to ensure that all of the ride vehicle components are functioning properly. To verify that the articulation joint 30 is working properly, the inspector pushes or pulls the test handle 70 (or other test element), in a direction of rotation of the secondary shaft 34, in an attempt to rotate the secondary shaft 34. If the secondary shaft 34 rotates, it is an indication that the secondary shaft 34 is not handling the loads acting on the articulation joint 30, and that the primary shaft 32 is therefore handling the loads and functioning properly.

If the secondary shaft 34 does not freely rotate when the inspector pushes or pulls the test handle 70, it is an indication that the secondary shaft 34 is handling the loads acting on the articulation joint 30, and that the primary shaft 32 has therefore failed or is otherwise inoperable. In this case, the amusement ride vehicle 10 may be taken off the track for further inspection and repair. If the primary shaft 32 malfunctions during ride operation, the ride need not be stopped, because the secondary shaft then carries the loads acting on the joint 30.

The amusement ride vehicle 10 provides several advantages over existing amusement ride vehicles. First, the amusement ride vehicle 10 can be used on a track having tight curves, which is common on indoor amusement rides and outdoor rides located in compact areas. Without the articulation joint 30, the ride vehicle would have to be shorter to travel through the tight curves on these types of tracks. As a result, fewer passengers could ride in each vehicle, which often leads to longer waiting lines.

Even if a greater number of smaller ride vehicles were used, fewer people would be able to ride on the amusement ride when it is operating at or near full capacity, since the ride vehicles must be spaced apart from one another by a predetermined time interval and/or distance as a safety precaution. Thus, over a given time interval, more people can ride on an amusement ride that includes larger amusement ride vehicles 10, than on an amusement ride that includes several smaller vehicles.

Additionally, by using the dual-shaft articulation joint 30, the amusement ride vehicle 10 can continue to operate if the primary shaft 32 fails or is otherwise inoperable. The amusement ride vehicle 10 may then be removed from the track during non-operation hours and repaired off-line. As a result, the amusement ride is not shut down during operational hours when the primary shaft 32 on a ride vehicle 10 fails. Delays and line backups resulting from such a failure are therefore avoided.

While embodiments and applications of the present invention have been shown and described, it will be apparent to one skilled in the art that other modifications are possible without departing from the inventive concepts herein. The invention, therefore, is not to be restricted except by the following claims and their equivalents.

What is claimed is:

1. An amusement ride vehicle, comprising:

a first vehicle section including passenger means therein for holding passengers during motion of the ride vehicle;

a second vehicle section including second passenger means therein for holding passengers during motion of the ride vehicle; and an articulation joint connecting, and providing rotational movement between, the first and second vehicle sections, with the articulation joint comprising:

a first shaft for bearing loads acting on the articulation joint during normal operation of the articulation joint; and a second shaft located within the first shaft and being freely movable with respect to the first shaft and being free of any loads during normal operation of the articulation joint, the second shaft being configured for bearing loads acting on the articulation joint where the first shaft malfunctions.

2. The amusement ride vehicle of claim 1 further comprising a test element attached to the second shaft, wherein the second shaft is rotatable via the test element when the first shaft is operable.

3. The amusement ride vehicle of claim 2, wherein the second shaft is not rotatable via the test element when the second shaft is bearing loads acting on the articulation joint.

4. The amusement ride vehicle of claim 1 further comprising at least one bearing between the first and second shafts for providing relative rotation between the first and second shafts.

5. The amusement ride vehicle of claim 1 further comprising a chassis tube positioned concentrically around the first and second shafts, with the chassis tube connected to the first and second vehicle sections.

6. The amusement ride vehicle of claim 5 further comprising at least one bearing between the chassis tube and the first shaft for providing relative rotation between the chassis tube and the first shaft.

7. The amusement ride vehicle of claim 1 wherein the first shaft bears radial and axial loads during normal operation of the articulation joint.

8. The amusement ride vehicle of claim 1 wherein the second shaft bears radial and axial loads if the first shaft malfunctions.

9. An amusement ride vehicle, comprising:

a first vehicle section including a first chassis section;

a second vehicle section including a second chassis section;

a chassis tube rotatably connected to the first and second chassis sections for providing rotation between the first and second vehicle sections;

a primary shaft connected to the first and second chassis sections and positioned concentrically within the chassis tube for bearing loads during normal operation of the primary shaft; and a secondary shaft connected to the first and second chassis sections and positioned concentrically within the primary shaft and the secondary shaft being freely movable with respect to the primary shaft and being free of any loads during normal operation of the primary shaft, the second shaft being configured for bearing loads when the primary shaft is inoperable.

10. The amusement ride vehicle of claim 9 further comprising a test element attached to the secondary shaft, wherein the secondary shaft is rotatable via the test element when the primary shaft is operable.

11. The amusement ride of claim 9 further comprising at least one bearing positioned between the chassis tube and the primary shaft for providing relative rotation between the chassis tube and the primary shaft.

12. The amusement ride of claim 9 further comprising at least one bearing positioned between the primary shaft and the secondary shaft for providing relative rotation between the primary shaft and the secondary shaft.

13. The amusement ride vehicle of claim 9 wherein the primary shaft bears radial and axial loads when operable.

14. The amusement ride vehicle of claim 9 wherein the second shaft bears radial and axial loads if the primary shaft is inoperable.

15. An amusement ride vehicle, comprising:

a first vehicle section including passenger means therein for holding passengers during motion of the ride vehicle;

a second vehicle section including second passenger means therein for holding passengers during motion of the ride vehicle; and a joint connecting, and providing rotational movement between, the first and second vehicle sections, with the joint comprising:

a first shaft; and a second shaft positioned concentrically with respect to the first shaft, wherein the first and second shafts are rotatable relative to one another; and a test element connected to the second shaft, wherein the second shaft is rotatable via the test element when the second shaft is not bearing loads.

16. The amusement ride vehicle of claim 15 further comprising at least one bearing between the first and second shafts for providing relative rotation between the first and second shafts.

17. The amusement ride vehicle of claim 15 wherein the joint further comprises a chassis tube positioned concentrically around the first and second shafts, with the chassis tube connected to the first and second vehicle sections.

18. An amusement ride vehicle, comprising:

a first vehicle section including passenger means therein for holding passengers during motion of the vehicle;

a second vehicle section including second passenger means therein for holding passengers during motion of the vehicle; and articulating means for providing rotational movement between the first and second vehicle sections, wherein the articulating means comprises:

a first load-bearing means for bearing loads during normal operation of the articulating means; and a second load-bearing means for bearing loads when the first load-bearing means is inoperable and the second load-bearing means being located within the first load-bearing means, being freely movable with respect to the first load-bearing means and being free of any loads during normal operation of the articulating means.

19. The amusement ride vehicle of claim 18 wherein the first load-bearing means bears radial and axial loads during normal operation of the articulation means.

20. The amusement ride vehicle of claim 18 wherein the second load-bearing means bears radial and axial loads when the first load-bearing means is inoperable.

* * * * *